United States Patent [19]

Frank et al.

[11] Patent Number: 4,991,990

[45] Date of Patent: Feb. 12, 1991

[54] PHOTOGRAPH ALBUM ATTACHMENT ASSEMBLY

[75] Inventors: John W. Frank, Cottage Grove; Bruce E. Samuelson, West Lakeland Township, Washington County; Troy R. Weich, Maplewood, all of Minn.

[73] Assignee: Minnesota Mining and Manufacturing Company, Saint Paul, Minn.

[21] Appl. No.: 461,263

[22] Filed: Jan. 5, 1990

[51] Int. Cl.[5] ..... B42F 3/00; B42F 13/14

[52] U.S. Cl. ..... 402/53; 402/73

[58] Field of Search ..... 402/50, 51, 52, 53, 402/73

[56] References Cited

U.S. PATENT DOCUMENTS

| | | | |
|---|---|---|---|
| 445,031 | 1/1891 | Barlow | 402/53 |
| 637,309 | 11/1899 | Weston | 402/53 |
| 729,763 | 6/1903 | Hartman | 402/53 |
| 767,159 | 8/1904 | Maltby | 402/53 |
| 807,557 | 12/1905 | Hulquist | 402/53 |
| 809,587 | 1/1906 | Sussman | 402/53 |
| 816,421 | 3/1906 | Barlow | 402/53 |
| 1,658,749 | 2/1928 | Walker | 402/51 X |
| 1,731,296 | 10/1929 | Dawson | 402/51 |
| 1,978,352 | 10/1934 | Morehouse | 402/53 X |

*Primary Examiner*—Paul A. Bell

*Attorney, Agent, or Firm*—Donald M. Sell; Walter N. Kirn; William L. Huebsch

[57] ABSTRACT

A photo album held together by attachment assemblies, each including (1) a barrel part having an internally threaded tubular portion and a plate at one end that will not pass through the openings in the pages and attachment portions of covers for the album; and (2) a screw part comprising an externally threaded portion adapted to threadably engage the tubular portion, and a head at one end that also will not pass through the openings in the pages and the attachment portions. The plates have projections received in sockets in the attachment portion of the rear cover to restrict rotation of the barrel parts; and the heads on the screw parts have ridges along their peripheries and large diameters that afford easy manual engagement with them to engage or disengage the screw parts with respect to the barrel parts.

6 Claims, 1 Drawing Sheet

PHOTOGRAPH ALBUM ATTACHMENT ASSEMBLY

TECHNICAL FIELD

The present invention relates to attachment assemblies for releasably attaching together the pages and covers of a photographic album.

BACKGROUND ART

Photo albums are known that comprise (1) a stack of pages adapted to receive photographs that have spaced through openings along their spine edges; (2) front and rear covers each including a main portion adapted to overlay the pages, an elongate attachment portion having through openings that is adapted to overlay narrow portions of the pages around the openings and adjacent their spine edges, and a flexible hinge portion attaching an outer edge of the attachment portion to the spine edge of the main portion to afford relative movement thereof between a closed position with the attachment portion along the inner surface of the main portion, and an open position with the inner surface of the main portion spaced from the attachment portion; and (3) a plurality of (typically two) attachment assemblies, each including a barrel part comprising an internally threaded tubular portion adapted to pass through the opening in the pages and the attachment portions, and a plate portion at one end of the tubular portion having a periphery larger than the diameter of the tubular portion so that the plate will not pass through the openings in the pages and the attachment portions; and a screw part comprising an externally threaded portion threadably engaged with the tubular portion, and a head at one end having a periphery larger than the diameter of the tubular portion so that the head will not pass through the openings in the pages and the attachment portions. The attachment assemblies are positioned through the openings in the stack of pages and the attachment portions with the plate and head on the sides of the attachment portions opposite the stack of pages, and the main portions of the front and rear covers overlying the plates and heads when the main portions are in the closed positions.

Typically the plate portion of the barrel part in such an attachment assembly is round and concentric with the tubular portion, and the head of the screw part is also round and of a rather small diameter. The threads on the screw part and the barrel part are adapted for low friction engagement, and the head of the screw part has a transverse slot that will receive a thumbnail or screwdriver or the edge portion of a coin by which the screw part can be tightened into or removed from the barrel part. Such tightening or removal can be complicated by any added friction in the threads, as may be caused by corrosion or a burr, so that the barrel part will rotate with the screw part, and the parts can not be fully engaged or separated without the inconvenient use of a pliers or similar tool to engage the plate portion of the barrel part.

DISCLOSURE OF THE INVENTION

The present invention provides improvements in an attachment assembly, a plurality of which attachment assemblies are used in a photo album of the type described above, which improvements allow a user to easily and reliably open and close the attachment assemblies without resorting to tools.

In the improved attachment assembly according to the present invention, the plates have projections generally parallel to, along and spaced from the tubular portions adapted to be positioned in sockets in at least one of the attachment portions to restrict rotation of the plate and thereby the barrel part relative to the one attachment portion; and the heads on the screw parts have ridges along their peripheries adapted for manual engagement and have diameters about equal to the width of at least the other one of the attachment portions to afford easy manual engagement with the peripheries along the inner edge of the other one of the attachment portions.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
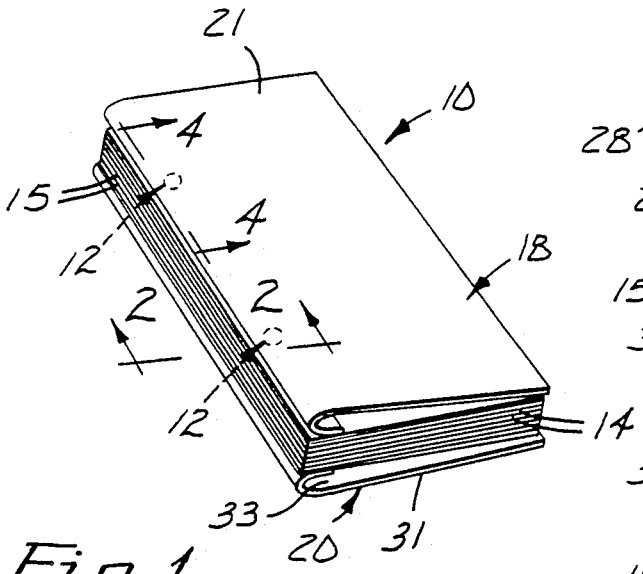
FIG. 1 is a perspective view of a photographic album including improved attachment assemblies according to the present invention.

Referring now to the drawing, there is shown a photo album 10 including two improved attachment assemblies 12 according to the present invention.

Figure 2:
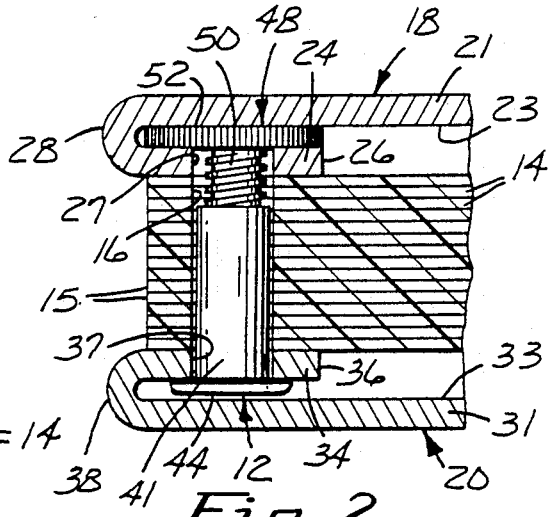
FIG. 2 is an enlarged fragmentary sectional view taken approximately along line 2—2 of FIG. 1.
Figure 3:
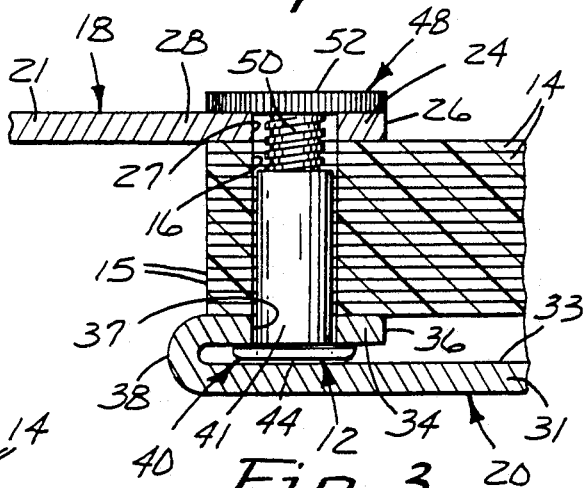
FIG. 3 is a view similar to FIG. 2 except that a major portion of a cover included in the album is shown in an open position.
Figure 4:
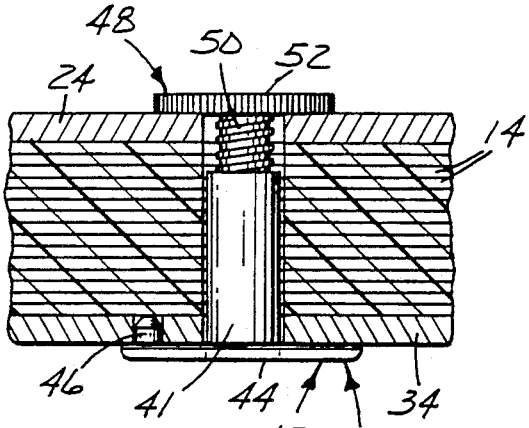
FIG. 4 is an enlarged fragmentary sectional view taken approximately along line 4—4 of FIG. 1 and in which major portions of covers on the album are not shown.

The photo album 10 comprises a stack of pages 14 adapted to receive photographs, each of which pages 14 has a spine edge 15 and two spaced openings 16 (e.g., 0.79 centimeter or 5/16 inch diameter) through the page 14 along the spine edge 15. The photo album 10 also includes front and rear covers 18 and 20. The front cover 18 includes (1) a main portion 21 having a spine edge and an inner major surface 23 of a size adapted to overlay the pages 14 when the spine edge of the main portion 21 extends along and parallel to the spine edges 15 of the pages 14; (2) an elongate attachment portion 24 adapted to overlay narrow portions of the pages 14 around the openings 16 and adjacent the spine edges 15 of the pages 14, the attachment portion 24 having an outer edge adapted to lay adjacent to and parallel with the spine edges 15 of the pages 14, having an inner edge 26 opposite and parallel to its outer edge, having a predetermined width between its inner and outer edges, and having through openings 27 with a slightly smaller diameter (e.g., 0.71 centimeter or 9/32 inch) and the same spacing as the openings 16 in the pages 14; and (3) a flexible hinge portion 28 attaching the outer edge of the attachment portion 24 to the spine edge of the main portion 21 to afford movement of the main portion 21 relative to the attachment portion 24 between a closed position (FIGS. 1 and 2) with the attachment portion 24 along the inner surface 23 of the main portion 21, and an open position (FIG. 3) with the inner surface 23 of the main portion 21 spaced from the attachment portion 24. Similarly, the rear cover 20 includes (1) a main portion 31 having a spine edge and an inner major surface 33 of a size adapted to overlay the pages 14 when the spine edge of the main portion 31 extends along the spine edges 15 of the pages 14; (2) an elongate attachment portion 34 adapted to overlay narrow portions of the pages 14 around the openings 16 and adjacent the spine edges 15 of the pages 14, the attachment portion 34 having an outer edge adapted to lay generally along the spine edges 15 of the pages 14, having an inner edge 36 opposite and parallel to its outer edge, having a predetermined width between its inner and outer edges, and having through openings 37 with a slightly smaller diameter (e.g., about 0.71 centimeter or 9/32 inch) and the same spacing as the openings 16 in the pages 14; and (3) a flexible hinge portion 38 attaching the outer edge of the attachment portion 34 to the spine edge of the main portion 31 to afford movement of the main portion 31 relative to the attachment portion 34 between a closed position (FIGS. 1, 2, and 3) with the attachment portion 34 along the inner surface 33 of the main portion 31, and an open position (not shown) with the inner surface 33 of the main portion 31 spaced from the attachment portion 34.

Figure 5:
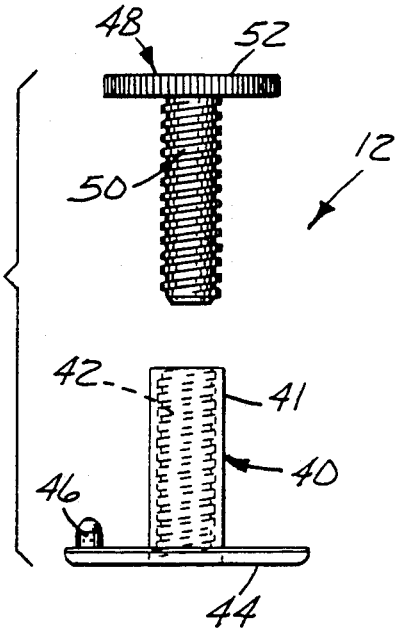
FIG. 5 is a side view of the attachment assembly according to the present invention having its parts separated.
Figure 6:
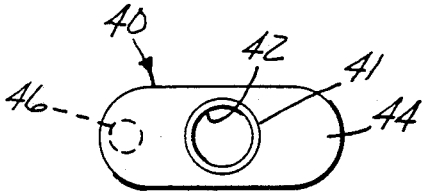
FIG. 6 is a bottom view of the barrel part of the fastener assembly as illustrated in FIG. 5.

The photo album 10 includes two of the improved attachment assemblies 12 according to the present invention, one of which is illustrated separated from the album 10 in FIG. 5. Each attachment assembly 12 includes a barrel part 40 comprising a tubular portion 41 having opposite ends, a through opening defined by internal threads 42 and an outer diameter (e.g., about 0.71 centimeter or 9/32 inch) adapted to pass through the openings 16, 27, and 37 in the pages 14 and the attachment portions 24 and 34, and an elongate plate 44 fixed at one end of the tubular portion 41 having a periphery larger than the diameter of the tubular portion 41 so that the plate 44 will not pass through the openings 37 and 16 in the attachment portion 34 and the pages 14. The plate 44 has a generally cylindrical projection 46 with a frustro conical tip generally parallel to, along and spaced from the tubular portion 41 to which the plate 44 is attached, which projection 46 is received in a socket in the attachment portion 34 for the rear cover 20 against which the plate 44 is positioned so that the walls defining the socket in which the projection 46 is received will restrict rotation of the plate 44 and thereby the barrel part 40 relative to that attachment portion 34. Each attachment assembly 12 also includes a screw part 48 comprising an externally threaded portion 50 having opposite ends and an end portion adapted to threadably engage the internal threads 42 in the tubular portion 41; and a circular disk-like head 52 at one of its ends having a periphery larger than the diameter of the tubular portion 41 so that the head 52 will not pass through the openings 27 and 16 in the attachment portion 24 and the pages 14. The circular head 52 on the screw part 48 has axially extending circumferentially spaced ridges along its periphery, which ridges are adapted for manual engagement by a user to facilitate engagement of the screw part 48 with, or disengagement of the screw part 48 from, the barrel part 40. Also, the head 52 has a diameter about equal to the width of the attachment portion 24 included in the front cover 18 between its inner and outer edges (e.g., a width of about 1.9 centimeters or ¾ inch) to afford easy manual engagement with the ridges on its periphery, particularly along the inner edge 26 of that attachment portion 24 to facilitate engagement or disengagement of the screw part 48 with respect to the barrel part 40. The screw and barrel parts 48 and 40 are preferably cast of a metal or polymeric material such as zinc or nylon. Also, preferably the thread on the screw part 48 has a longer lead than threads conventionally used on threaded portions of a similar diameter, such as a 0.063 inch pitch and an 0.27 inch outside diameter.

In the assembled album 10, the attachment assemblies 12 are positioned with their tubular portions 41 and their threaded end portions 50 in threaded engagement in the through the openings 27, 37, and 16 in the attachment portions 24 and 34 and the stack of pages 14 with their plates 44 and heads 52 on the sides of the attachment portions 24 and 34 opposite the stack of pages 14 to hold the album 10 together, and so that the main portions 21 and 31 of the front and rear covers 18 and 20 can be moved from their closed positions overlaying the plates 44 and heads 52, to their open positions spaced from their attachment portions 24 and 34 and the plates 44 and heads 52 to facilitate access to the pages 14. When it is desired to add, delete or change the position of a page 14, a user simply moves the main portion 21 of the front cover to its open position to afford access to the heads 52, rotates the heads 52 to disengage the threaded portions 50 from the tubular portions 41, which rotation is facilitated in that the ridges along the edges of the heads 52 are easily manually engageable, particularly along the inner edge 26 of the attachment portion 24, and because the tubular portions 41 will not rotate with the heads 52 due to engagement of the projections on the plates 44 in the sockets in the attachment portions 34. After the desired addition, deletion or change is made, the user can again engage the threaded portions 50 with the tubular portions 41 through the attachment portion of the front cover, which will again be facilitated because the tubular portions 41 will not rotate with the heads 52 due to engagement of the projections on the plates 44 in the sockets in the attachment portions 34, and because the ridges along the edges of the heads 52 are easily manually engageable, particularly along the inner edge 26 of the attachment portion 24 as the threaded portions 50 are fully engaged with the tubular portions 41.

The present invention has now been described with reference to one embodiment thereof. It will be apparent to those skilled in the art that many changes can be made in the embodiment described without departing from the scope of the present invention. Thus the scope of the present invention should not be limited to the structure described in this application, but only by structures described by the language of the claims and the equivalents of those structures.

What is claimed is:

1. In a photo album comprising a stack of pages adapted to receive photographs said pages having spine edges and spaced openings through said pages along said spine edges;

front and rear covers each including:

a main portion having a spine edge and an inner major surface of a size adapted to overlay said pages when the spine edge of the main portion extends parallel to the spine edges of said pages;

an elongate attachment portion adapted to overlay narrow portions of the pages around the openings and adjacent the spine edges of the pages, said attachment portion having an outer edge adapted to lay adjacent and parallel with the spine edges of the sheets, having an inner edge opposite and parallel to said first edge, having a predetermined width between said inner and outer edges, and having through openings with the same spacing as the openings in said pages, and a flexible hinge portion attaching said outer edge of said attachment portion to the spine edge of said main portion to afford movement of said main portion relative to said attachment portion between a closed position with the attachment portion along the inner surface of the main portion, and an open position with the inner surface of the main portion spaced from the attachment portion; and a plurality of attachment assemblies, each including a barrel part comprising a tubular portion having opposite ends, a through opening defined by internal threads and an outer diameter adapted to pass through the opening in said pages and said attachment portions; and a plate at one end of the tubular portion having a periphery larger than the diameter of the tubular portion so that the plate will not pass through the openings in the pages and the attachment portions; and a screw part comprising an externally threaded portion having opposite ends and adapted to threadably engage the internal threads in said tubular portion; and a head at one of said ends having a periphery larger than the diameter of the tubular portion so that the head will not pass through the openings in the pages and the attachment portions, said head including means adapted to afford engagement of the head by a user to afford engagement of the screw part with and disengagement of the screw part from the barrel part;

said attachment assemblies being inserted through the openings in the stack of pages and the attachment portions with the plate and head on the sides of the attachment portions opposite the stack of pages, and said main portions of said front and rear covers overlying said plates and heads when said main portions are in said closed positions; the improvement wherein:

said plates have projections generally parallel to, along and spaced from said tubular portions;

at least one of said attachment portions has sockets receiving said projections to restrict rotation of said plates and thereby said barrel parts relative to said one attachment portion; and said heads on said screw parts have ridges along their peripheries adapted for manual engagement and diameters about equal to the width of at least the other one of said attachment portions to afford easy manual engagement with said peripheries along the inner edge of said other one of said attachment portions.

2. A photo album according to claim 1 wherein said attachment portion of said rear cover has said sockets, said plates are positioned along said attachment portion of said rear cover, said heads are positioned along the attachment portion of said front cover and have a width of about 1.9 centimeters ($\frac{3}{4}$ inch).

3. A photo album according to claim 1 wherein said attachment assemblies are of polymeric material.

4. Improvements in an attachment assembly, a plurality of which attachment assemblies are used in a photo album comprising a stack of pages adapted to receive photographs said pages having spine edges and spaced openings through said pages along said spine edges; and front and rear covers each including:

a main portion having a spine edge and an inner major surface of a size adapted to overlay said pages when the spine edge of the main portion extends parallel to the spine edges of said pages;

an elongate attachment portion adapted to overlay narrow portions of the pages around the openings and adjacent the spine edges of the pages, said attachment portion having an outer edge adapted to lay adjacent and parallel with the spine edges of the sheets, having an inner edge opposite and parallel to said first edge, having a predetermined width between said inner and outer edges, and having through openings with the same spacing as the openings in said pages, and a flexible hinge portion attaching said outer edge of said attachment portion to the spine edge of said main portion to afford movement of said main portion relative to said attachment portion between a closed position with the attachment portion along the inner surface of the main portion, and an open position with the inner surface of the main portion spaced from the attachment portion;

said attachment assembly including a barrel part comprising a tubular portion having opposite ends, a through opening defined by internal threads and an outer diameter adapted to pass through the opening in said pages and said attachment portions; and a plate at one end of the tubular portion having a periphery larger than the diameter of the tubular portion so that the plate will not pass through the openings in the pages and the attachment portions; and a screw part comprising an externally threaded portion having opposite ends and adapted to threadably engage the internal threads in said tubular portion; and a head at one of said ends having a periphery larger than the diameter of the tubular portion so that the head will not pass through the openings in the pages and the attachment portions, said head including means adapted to afford engagement of the head by a user to afford engagement of the screw part with and disengagement of the screw part from the barrel part;

said attachment assemblies being adapted to be inserted through the openings in the stack of pages and the attachment portions with the plate and head on the sides of the attachment portions opposite the stack of pages, and said main portions of said front and rear covers overlying said plates and heads when said main portions are in said closed positions; the improvement wherein:

said plates have projections generally parallel to, along and spaced from said tubular portions adapted to be positioned in sockets in at least one of said attachment portions to restrict rotation of said plate and thereby said barrel part relative to said one attachment portion; and said heads on said screw parts have ridges along their peripheries adapted for manual engagement and diameters about equal to the width of at least the other one of said attachment portions to afford easy manual engagement with said peripheries along the inner edge of said other one of said attachment portions.

5. A photo album according to claim 4 wherein said head has a width of about 1.9 centimeters ($\frac{3}{4}$ inch).

6. A photo album according to claim 4 wherein said attachment assembly is of polymeric material.

* * * * *